US007579781B2

(12) United States Patent
Lee et al.

(10) Patent No.: US 7,579,781 B2
(45) Date of Patent: Aug. 25, 2009

(54) ORGANIC ELECTRO-LUMINESCENT DISPLAY DEVICE AND METHOD FOR DRIVING THE SAME

(75) Inventors: Myung Ho Lee, Uiwang-Shi (KR); Juhn Suk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 616 days.

(21) Appl. No.: 11/289,491

(22) Filed: Nov. 30, 2005

(65) Prior Publication Data

US 2006/0208973 A1 Sep. 21, 2006

(30) Foreign Application Priority Data

Mar. 18, 2005 (KR) ..... 10-2005-0022763

(51) Int. Cl.
*G09G 3/10* (2006.01)
*G05F 1/00* (2006.01)

(52) U.S. Cl. ..... 315/169.3; 315/291; 345/77; 345/82; 345/204

(58) Field of Classification Search ... 315/169.1–169.3, 315/291, 307; 345/36, 39, 55, 76, 77, 82, 345/84, 204, 208, 690
See application file for complete search history.

(56) References Cited

U.S. PATENT DOCUMENTS

| | | | | |
|---|---|---|---|---|
| 6,417,825 | B1 * | 7/2002 | Stewart et al. | 345/77 |
| 6,809,710 | B2 * | 10/2004 | Prache et al. | 345/82 |
| 6,844,874 | B2 * | 1/2005 | Maurice | 345/208 |
| 7,038,394 | B2 * | 5/2006 | Yamashita | 315/169.3 |
| 2005/0225254 | A1 * | 10/2005 | Takai et al. | 315/169.3 |

* cited by examiner

*Primary Examiner*—Douglas W Owens
*Assistant Examiner*—Jimmy T Vu
(74) *Attorney, Agent, or Firm*—Birch, Stewart, Kolasch & Birch, LLP

(57) ABSTRACT

An organic electro-luminescent display device according to an embodiment includes a light emitting device in a pixel to emit light in response to a current applied thereto; a data line for providing a data voltage in a write period and a ramp voltage in a display period; and a first switching device connected to the light emitting device, the first switching device being selectively turned on depending on a voltage difference between the ramp voltage and the data voltage so as to drive the light emitting device.

24 Claims, 13 Drawing Sheets

ORGANIC ELECTRO-LUMINESCENT DISPLAY DEVICE AND METHOD FOR DRIVING THE SAME

This Nonprovisional Application claims priority under 35 U.S.C. §119(a) on patent application Ser. No. 10-2005-0022763 filed in Korea on Mar. 18, 2005, the entire contents of which are hereby incorporated by reference.

BACKGROUND OF THE INVENTION

1. Field of the Invention

The present invention relates to an organic electro-luminescent display device, and more particularly, to an organic electro-luminescent display device and a method for driving the same, wherein the high reliability can be maintained regardless of the variation in a threshold voltage of a drive switching device, and the area of a pixel unit and manufacturing cost can be reduced.

2. Discussion of the Related Art

Recently, various flat panel display devices have been developed to reduce weight and size which are disadvantages of a cathode ray tube device. These flat panel display devices includes, for example, a liquid crystal display, a field emission display, a plasma display panel, an electro-luminescent display, etc.

Research has been actively done for increasing the display quality and screen of such flat panel display devices. The electro-luminescent display, among them, is a spontaneous emission device that emits light by itself. This electro-luminescent display displays a video image by electrically exciting fluorescent material using carriers such as electrons and holes. Such electro-luminescent displays are roughly classified into an inorganic electro-luminescent display device and an organic electro-luminescent display device according to the type of materials used therein. The organic electro-luminescent display device is driven at a low voltage of about 5 to 20V. The organic electro-luminescent display device can be driven at a low direct current (DC) voltage as compared with the inorganic electro-luminescent display device which requires a high drive voltage of 100 to 200V. The organic electro-luminescent display device also has superior characteristics such as a wide viewing angle, a high-speed response, a high contrast ratio, etc., so that it can be utilized as a pixel of a graphic display, or a pixel of a television image display or surface light source. In addition, because the organic electro-luminescent display device is thin and light and can provide primary colors, it is suitable as a next-generation flat panel display.

On the other hand, a passive matrix type driving system having no separate thin film transistor is mainly used as a driving system of the organic electro-luminescent display device.

However, the passive matrix type driving system has many limitations in resolution, power consumption, lifetime, etc. For this reason, efforts have recently been made to research and develop an active matrix type electro-luminescent display device for fabrication of a next-generation display requiring a high resolution or large screen.

FIG. 1 is a circuit diagram showing one pixel structure of a conventional active matrix type organic electro-luminescent display device.

The one pixel structure of the conventional active matrix type organic electro-luminescent display device comprises, as shown in FIG. 1, a gate line GL arranged in one direction, a data line DL arranged perpendicularly to the gate line GL, an organic light emitting device (OLED) formed in a pixel defined by the gate line GL and the data line DL, a voltage supply line 110 for supplying a DC voltage to the anode of the OLED, a first NMOS transistor Tr1 having a gate terminal connected to the gate line GL and a drain terminal connected to the data line DL, a second NMOS transistor Tr2 having a gate terminal connected to the source terminal of the first NMOS transistor Tr1, a drain terminal connected to the cathode of the OLED and a source terminal connected to a ground terminal, and a capacitor C connected between the gate terminal and source terminal of the second NMOS transistor Tr2.

The first NMOS transistor Tr1 is turned on in response to a scan signal from the gate line GL to form a current path between the source terminal and drain terminal thereof. The first NMOS transistor Tr1 is also turned off when the voltage on the gate line GL is lower than a threshold voltage Vth thereof. During a turn-on time of the first NMOS transistor Tr1, a data voltage from the data line DL is applied to the gate terminal of the second NMOS transistor Tr2 through the drain terminal of the first NMOS transistor Tr1. On the contrary, during a turn-off time of the first NMOS transistor Tr1, the current path between the source terminal and drain terminal of the first NMOS transistor Tr1 is opened, thereby causing the data voltage not to be applied to the gate terminal of the second NMOS transistor Tr2.

The second NMOS transistor Tr2 adjusts the amount of current flowing between the source terminal and drain terminal thereof according to the level of the data voltage applied to the gate terminal thereof to actuate the OLED so as to emit light of an intensity corresponding to the data voltage.

The capacitor C sustains the data voltage applied to the gate terminal of the second NMOS transistor Tr2 constantly for a period of one frame. The capacitor C also sustains current applied to the OLED constantly for the period of one frame.

Meanwhile, the data voltage applied to the gate terminal of the second NMOS transistor Tr2 has a constant polarity (positive polarity), and the source terminal of the second NMOS transistor Tr2 is connected to the ground terminal. As a result, the gate-source voltage of the second NMOS transistor Tr2 has the positive polarity, resulting in a problem in that the threshold voltage of the second NMOS transistor Tr2 rises continuously toward one polarity (positive polarity). The rising of the threshold voltage of the second NMOS transistor Tr2 causes a reduction in the amount of the current supplied to the OLED and, in turn, a reduction in brightness of the OLED, which leads to a degradation in image quality.

SUMMARY OF THE INVENTION

Accordingly, the present invention is directed to an organic electro-luminescent display device and a method for driving the same that substantially obviate one or more problems due to limitations and disadvantages of the related art.

An object of the present invention is to provide an organic electro-luminescent display device and a method for driving the same, wherein the threshold voltage of a switching device for driving an organic light emitting device is stored, and then offset and removed by the threshold voltage of the switching device in a display period, so that the high reliability can be maintained regardless of the variation in the threshold voltage of the switching device resulting from a deterioration of the switching device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic electro-luminescent display device comprises: a light emitting device in a pixel to emit light in response to a current applied thereto; a data line for providing a data voltage in a write period and a ramp voltage in a display period; and a first switching device connected to the light emitting device, the first switching device being selectively turned on depending on a voltage difference between the ramp voltage and the data voltage so as to drive the light emitting device.

In another aspect of the present invention, there is provided a method for driving an organic electro-luminescent display device, including: supplying a data voltage via a data line during a write period to charge a capacitor between the data line and a first switching device; supplying a ramp voltage via the data line during a display period; and selectively turning on the first switching device depending on a voltage difference between the ramp voltage and the data voltage so as to drive the light emitting device.

In another aspect of the present invention, an organic electro-luminescent display device comprises: a light emitting device in a pixel to emit light in response to a current applied thereto; a first switching device connected to the light emitting device for driving the light emitting device; a data line for providing a data voltage in a write period and a ramp voltage in a display period; and a capacitor connected to and between the data line and a gate terminal of the first switching device.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

An organic electro-luminescent display device according to a first embodiment of the present invention will hereinafter be described in detail with reference to the annexed drawings. It should be noted that although the organic electro-luminescent display device using NMOS transistors is used to illustrate the embodiments, the present invention can also apply to the organic electro-luminescent display device using other transistors such as PMOS transistors or other types of transistors.

Figure 1:
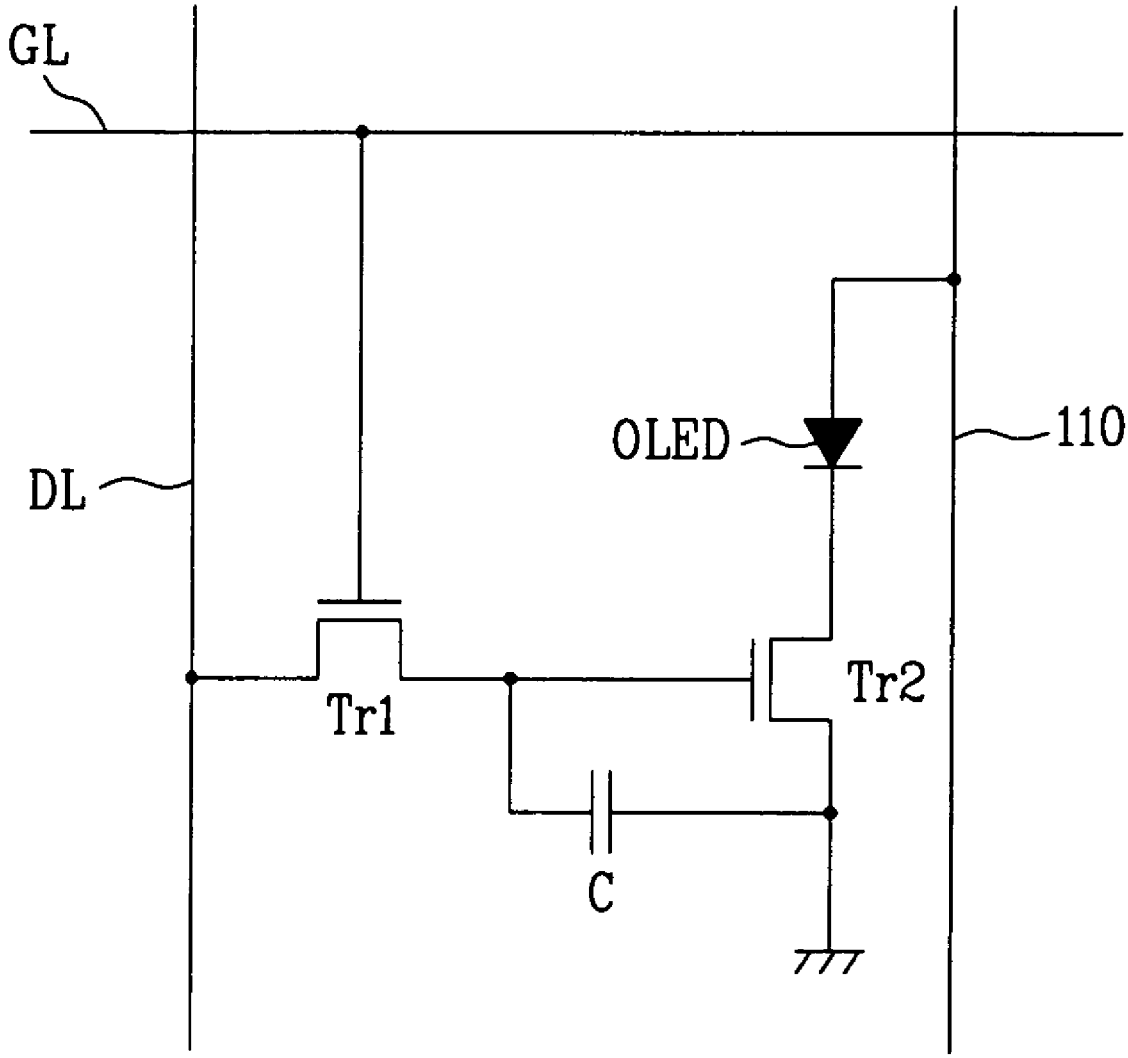
FIG. 1 Related Art
FIG. 1 is a circuit diagram showing one pixel structure of a conventional active matrix type organic electro-luminescent display device.
Figure 2:
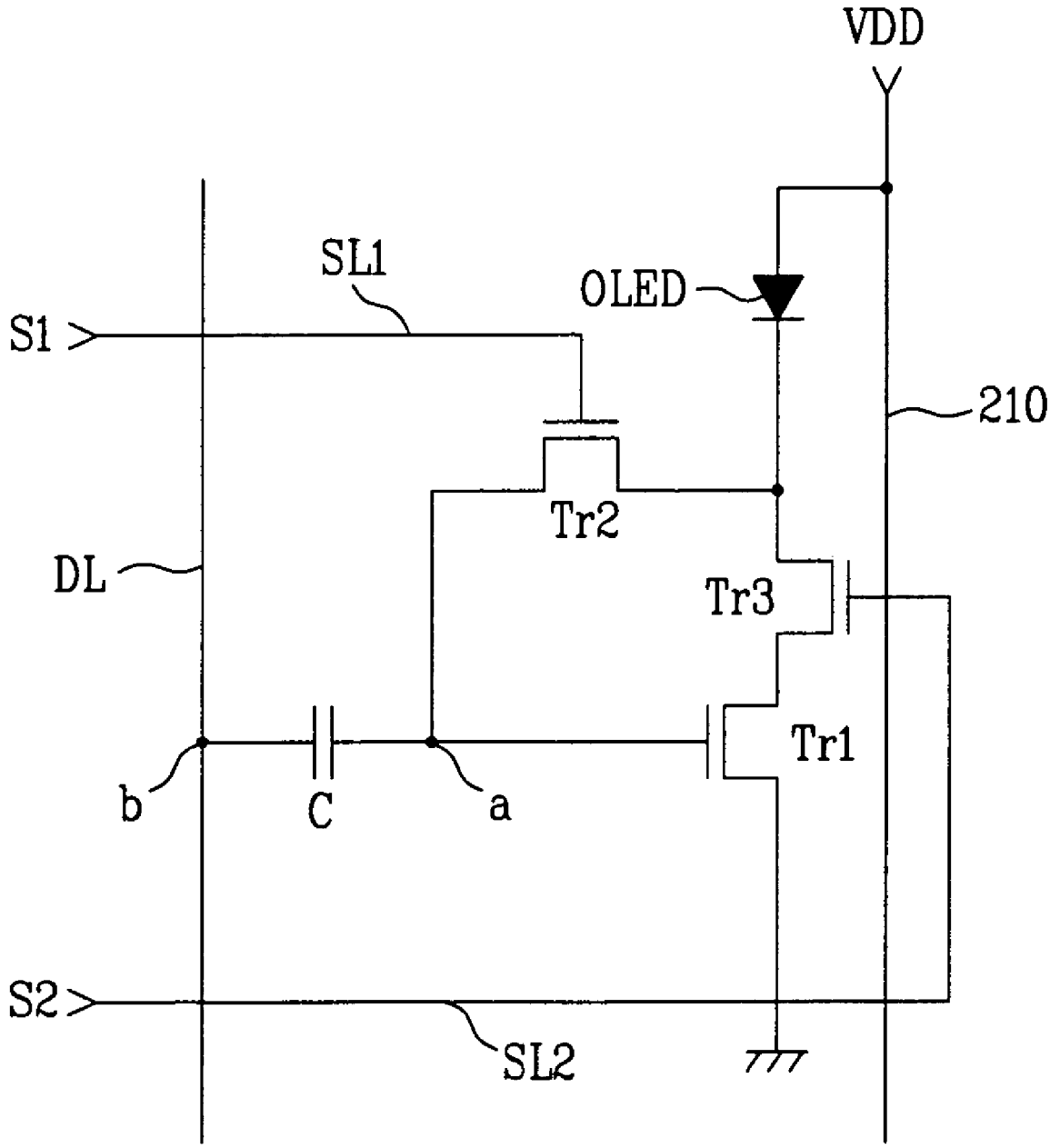
FIG. 2 is a circuit diagram showing an equivalent circuit of one pixel in an organic electro-luminescent display device according to a first embodiment of the present invention.

FIG. 2 is a circuit diagram showing an equivalent circuit of one pixel in the organic electro-luminescent display device according to the first embodiment of the present invention.

The one pixel structure of the organic electro-luminescent display device according to the first embodiment of the present invention comprises, as shown in FIG. 2, an organic light emitting device (OLED) for emitting light in response to a current applied thereto, a first scan line SL1 for transferring a first scan pulse S1 from a gate driver (not shown), a second scan line SL2 for transferring a second scan pulse S2 from the gate driver, a data line DL for transferring a data voltage Vd and a ramp voltage Vramp from a data driver (not shown), a first NMOS transistor Tr1 for applying the current to the OLED depending on the level of the data voltage Vd from the data line DL, and a second NMOS transistor Tr2 connected between the gate terminal of the first NMOS transistor Tr1 and the cathode of the OLED. The second NMOS transistor Tr2 is turned on in response to the first scan pulse S1 from the first scan line SL1 to form a short circuit between the gate terminal of the first NMOS transistor Tr1 and the cathode of the OLED. The one pixel structure of the organic electro-luminescent display device according to the first embodiment of the present invention further comprises a third NMOS transistor Tr3 connected between the drain terminal of the first NMOS transistor Tr1 and the cathode of the OLED and turned on in response to the second scan pulse S2 from the second scan line SL2 to form a short circuit between the drain terminal of the first NMOS transistor Tr1 and the cathode of the OLED, a voltage supply line 210 connected to the anode of the OLED for supplying a voltage VDD to the OLED, and a capacitor C connected between the gate terminal of the first NMOS transistor Tr1 and the data line DL.

A detailed description will hereinafter be given of the operation of the organic electro-luminescent display device with the above-stated configuration according to the first embodiment of the present invention.

Figure 3:
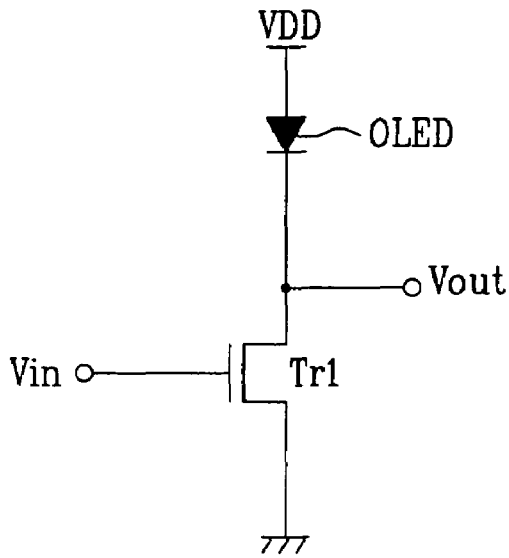
FIG. 3 is a circuit diagram illustrating operation characteristics of the first NMOS transistor in FIG. 2.
Figure 4:
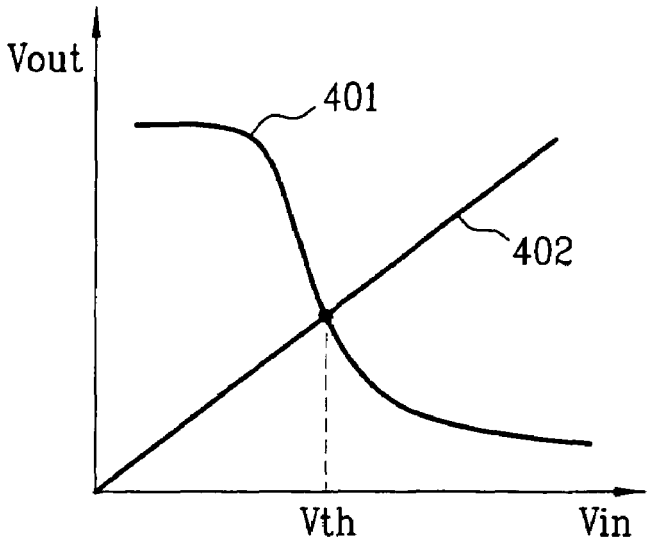
FIG. 4 is a graph illustrating an input voltage to output voltage characteristic curve and the threshold voltage of the first NMOS transistor of FIG. 3.

FIG. 3 is a circuit diagram illustrating operation characteristics of the first NMOS transistor Tr1 in FIG. 2, and FIG. 4 is a graph illustrating an input voltage to output voltage characteristic curve and threshold voltage of the first NMOS transistor Tr1 of FIG. 3.

The circuit of FIG. 2 can be re-expressed in a circuit form in which a load, or an OLED, is connected to the drain terminal of the first NMOS transistor Tr1, as shown in FIG. 3. In this case, due to the connection of the OLED to the drain terminal of the first NMOS transistor Tr1, the higher an input voltage Vin to the gate terminal of the first NMOS transistor Tr1, the lower an output voltage Vout from the drain terminal of the first NMOS transistor Tr1.

In other words, when the input voltage Vin is applied to the gate terminal of the first NMOS transistor Tr1, the first NMOS transistor Tr1 is turned on, thereby causing the current to flow between the drain terminal and source terminal of the first NMOS transistor Tr1. As a result, the voltage VDD is divided and distributed to the OLED and the drain terminal-source terminal of the first NMOS transistor Tr1. At this time, because the OLED, connected between the drain terminal of the first NMOS transistor Tr1 and a voltage generator (not shown) outputting the voltage VDD, has a resistance set to be larger than the internal resistance of the first NMOS transistor Tr1, the voltage VDD is distributed more to the OLED. Consequently, the higher the input voltage Vin, the lower the output voltage Vout from the first NMOS transistor Tr1 (i.e., from the drain terminal of the first NMOS transistor Tr1).

Hence, the input voltage Vin to output voltage Vout characteristic curve, denoted by the reference numeral 401, of the first NMOS transistor Tr1 exhibits an inverter characteristic where the input voltage Vin and the output voltage Vout have an inverse proportional relationship, as shown in FIG. 4.

The operation of one pixel in the organic electro-luminescent display device according to the first embodiment of the present invention will hereinafter be described in detail on the basis of this principle.

Figure 5:
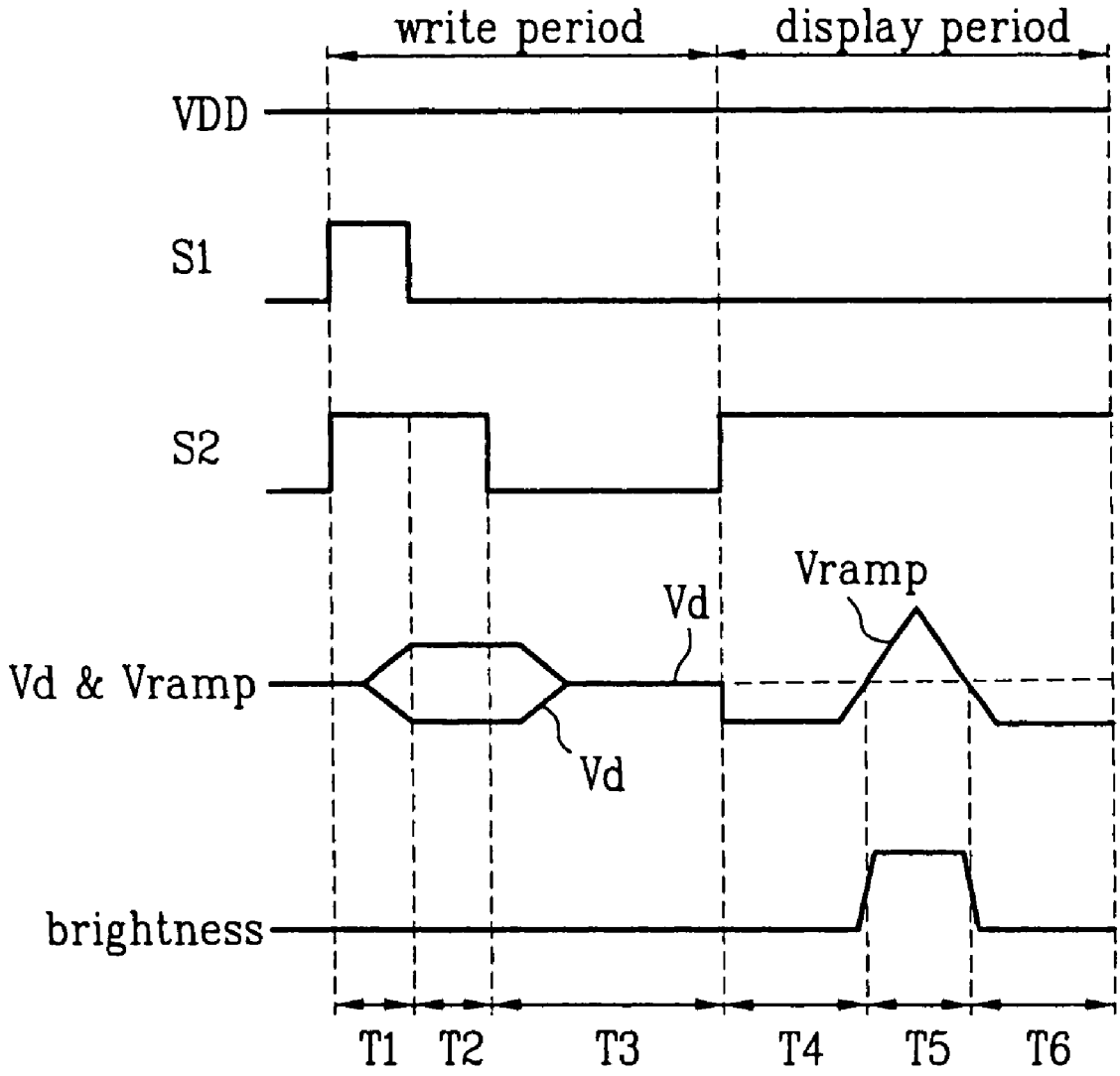
FIG. 5 is a timing diagram of various signals which are applied to the circuit of FIG. 2.
Figure 6A:
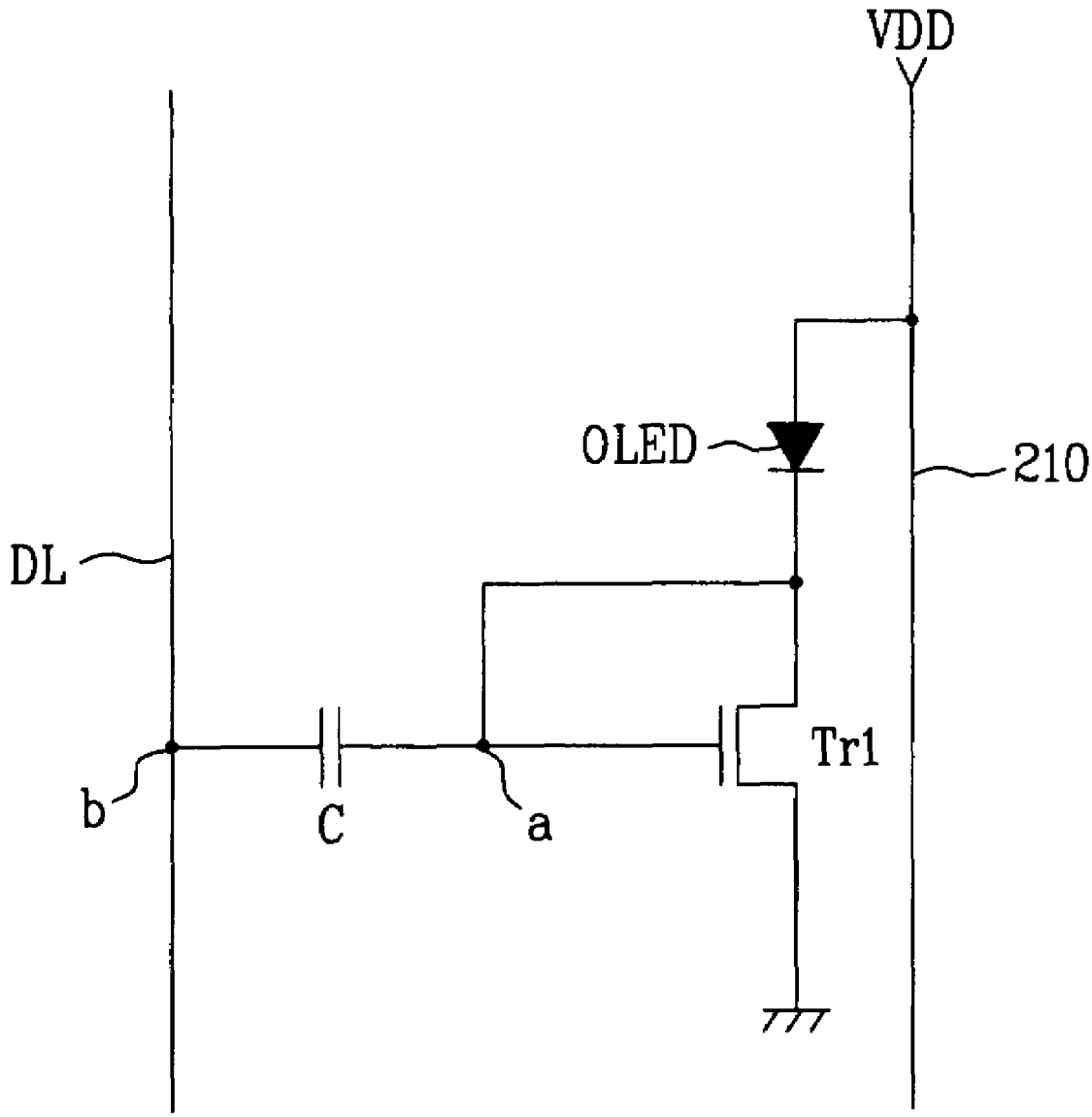
FIG. 6A is an equivalent circuit diagram of the circuit of FIG. 2 in the first period.

FIG. 5 is a timing diagram of the various signals which are applied to the circuit of FIG. 2, and FIG. 6A is an equivalent circuit diagram of the circuit of FIG. 2 in the first period T1.

First, in the first period T1, both the first scan pulse S1 and second scan pulse S2 remain high, as shown in FIG. 5. The data voltage Vd from the data driver also begins to be applied to the data line DL.

As a result, in the first period T1, both the second and third NMOS transistors Tr2 and Tr3 in FIG. 2 remain on. The circuit configuration in the first period T1 where the second and third NMOS transistors Tr2 and Tr3 remain on can be equivalently re-expressed as shown in FIG. 6A.

That is, as shown in FIG. 6A, each of the turned-on second and third NMOS transistors Tr2 and Tr3 can be expressed in the form of a short circuit. Thus, the first NMOS transistor Tr1 can be expressed in the form of a diode as a short circuit is formed between the gate terminal and drain terminal thereof.

For this reason, the gate terminal and drain terminal of the first NMOS transistor Tr1 have the same voltage. In other words, the gate terminal of the first NMOS transistor Tr1 signifies an input terminal to which the input voltage Vin is applied, and the drain terminal of the first NMOS transistor Tr1 signifies an output terminal from which the output voltage Vout is outputted. As shown in FIG. 4, the input voltage Vin and the output voltage Vout can be expressed as a straight line 402 as they are maintained at the same value. At this time, a voltage value at a point at which the straight line 402 and the curve 401 cross each other signifies a voltage value applied to the gate terminal and drain terminal of the first NMOS transistor Tr1.

Here, the voltage applied to the gate terminal and drain terminal of the first NMOS transistor Tr1 becomes equal to a threshold voltage Vth of the first NMOS transistor Tr1 in the end. As a result, the threshold voltage Vth of the first NMOS transistor Tr1 is applied to a first node a via which the gate terminal of the first NMOS transistor Tr1 and the capacitor are connected with each other.

Meanwhile, in the first period T1, the data voltage Vd applied to the data line DL is applied to a second node b to which the data line DL and the capacitor C are connected in common. Hence, the threshold value Vth and the data voltage Vd are applied to both ends of the capacitor C, respectively, thereby causing a voltage difference Vd−Vth between the data voltage Vd and the threshold voltage Vth to be charged in the capacitor C.

In summary, in the first period T1, the voltage difference Vd−Vth between the data voltage Vd and the threshold voltage Vth of the first NMOS transistor Tr1 charges the capacitor C.

Next, a description will hereinafter be given of the operation of the circuit of FIG. 2 in the second period T2.

Figure 6B:
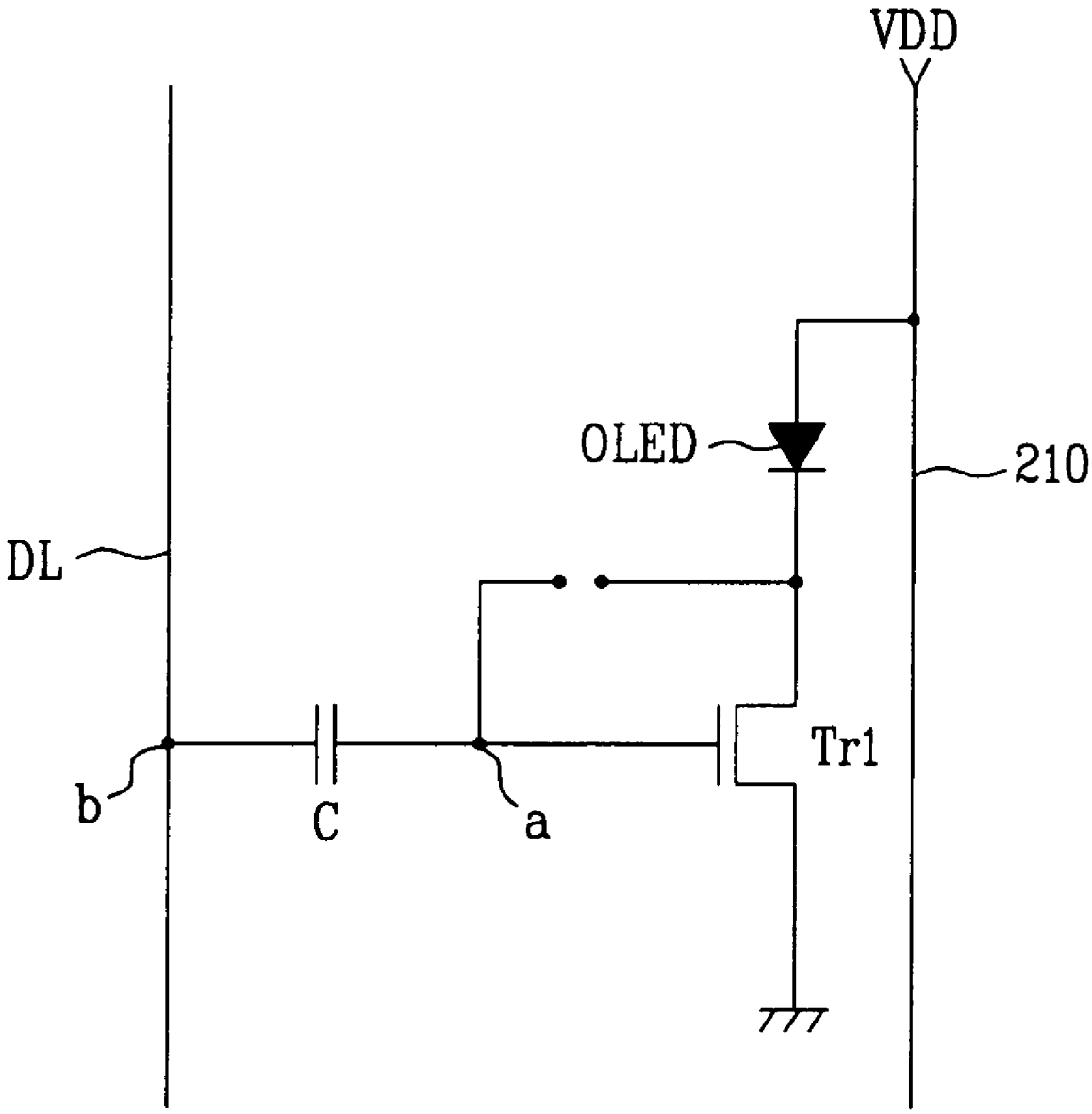
FIG. 6B is an equivalent circuit diagram of the circuit of FIG. 2 in the second period.

FIG. 6B is an equivalent circuit diagram of the circuit of FIG. 2 in the second period T2.

In the second period T2, the first scan pulse S1 goes low and the second scan pulse S2 still remains high, as shown in FIG. 5.

As a result, the second NMOS transistor Tr2 in FIG. 2 is turned off and the third NMOS transistor Tr3 in FIG. 2 is turned on. The circuit configuration in the second period T2 where the second NMOS transistor Tr2 is turned off and the third NMOS transistor Tr3 is turned on can be equivalently re-expressed as shown in FIG. 6B.

That is, as shown in FIG. 6B, the turned-on third NMOS transistor Tr3 can be expressed in the form of a short circuit.

Next, a description will hereinafter be given of the operation of the circuit of FIG. 2 in the third period T3.

Figure 6C:
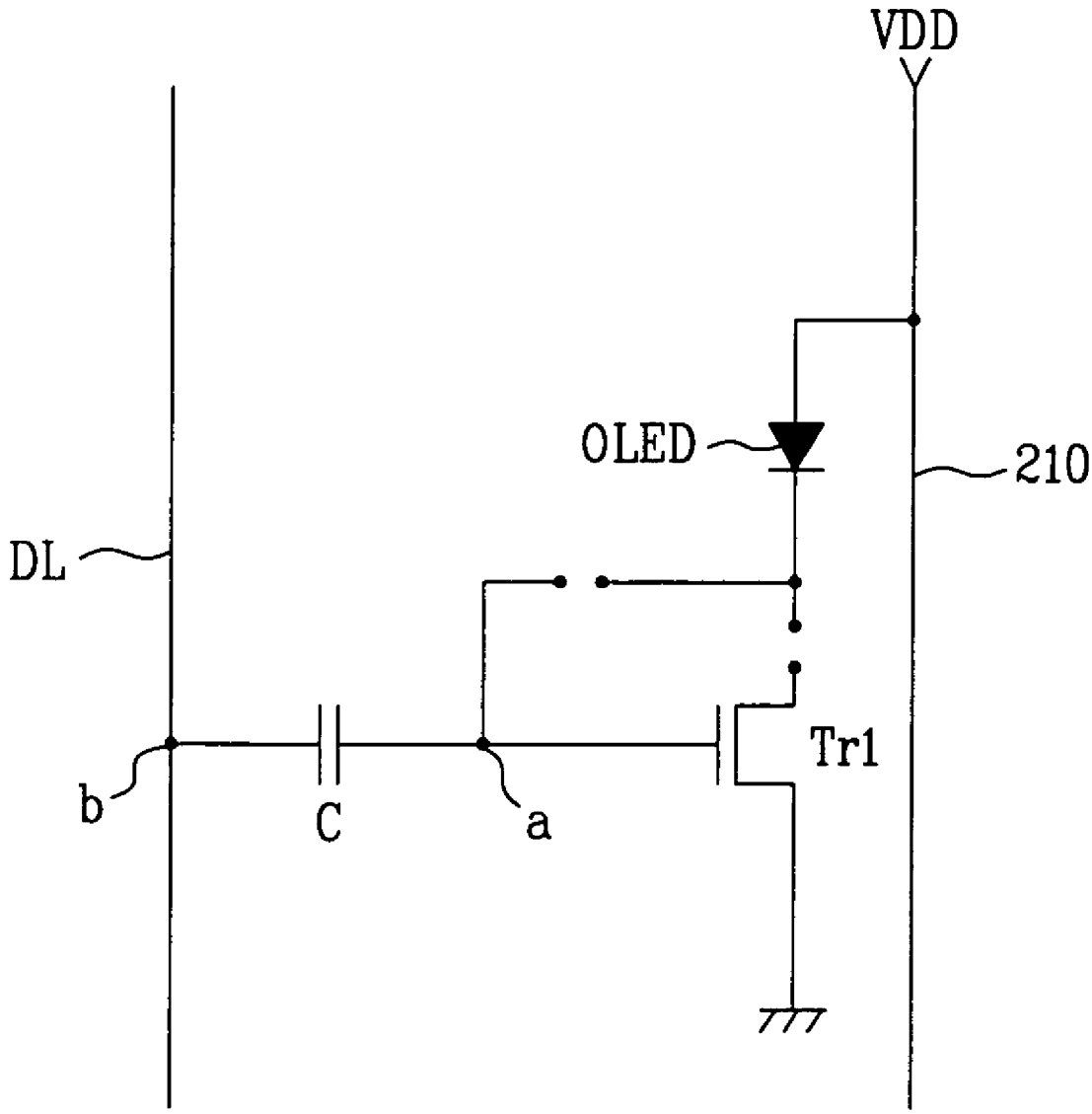
FIG. 6C is an equivalent circuit diagram of the circuit of FIG. 2 in the third period.

FIG. 6C is an equivalent circuit diagram of the circuit of FIG. 2 in the third period T3.

In the third period T3, both the first scan pulse S1 and second scan pulse S2 remain low, as shown in FIG. 5. As a result, both the second and third NMOS transistors Tr2 and Tr3 in FIG. 2 remain off. The circuit configuration in the third period T3 where the second and third NMOS transistors Tr2 and Tr3 remain off can be equivalently re-expressed as shown in FIG. 6C.

That is, as shown in FIG. 6C, both the turned-off second and third NMOS transistors Tr2 and Tr3 can be expressed in the form of an open circuit.

Here, in the second period T2 and third period T3, the voltage difference Vd−Vth between the data voltage Vd and the threshold voltage Vth, stored in the capacitor C, is sustained. By sequentially turning off the second NMOS transistor Tr2 and the third NMOS transistor Tr3 over the two periods as stated above, it can minimize the effect of the variation in the voltage Vd−Vth stored in the capacitor C.

The above-described first to third periods T1 to T3 correspond to a write period for charging and sustaining the voltage difference Vd−Vth between the data voltage Vd and the threshold voltage Vth in the capacitor C. In this write period, the OLED emits no light. Of course, when the data voltage Vd is high, the OLED may emit light in the first and second periods T1 and T2. However, because the first and second periods T1 and T2 are considerably short, the entire screen may be considered to be displayed in black in those periods.

A display period is started subsequently to the write period. A detailed description will hereinafter be given of the operation of the circuit of FIG. 2 in the display period.

Figure 6D:
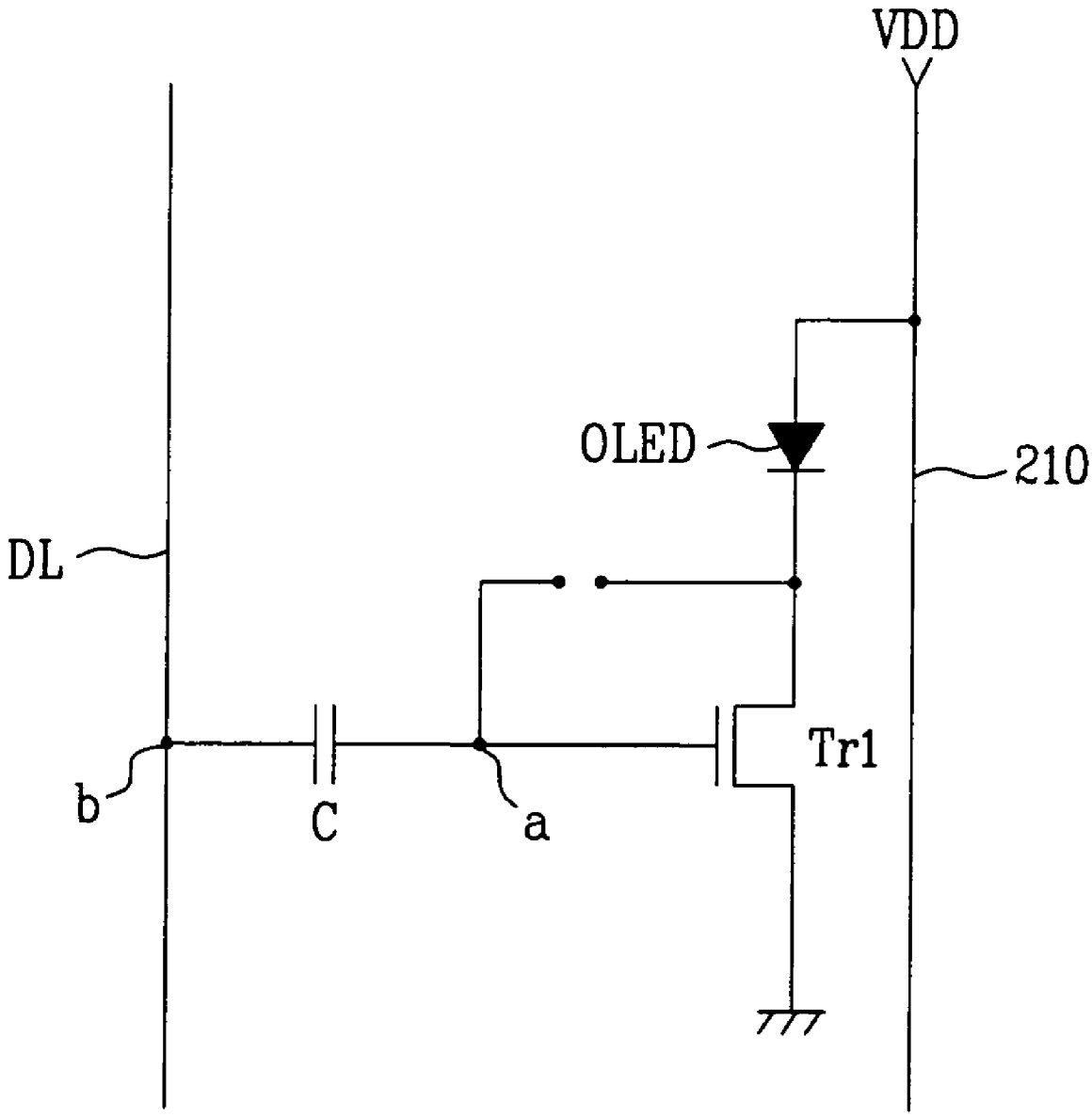
FIG. 6D is an equivalent circuit diagram of the circuit of FIG. 2 in a display period.

FIG. 6D is an equivalent circuit diagram of the circuit of FIG. 2 in the display period.

In the display period, the OLED actually emits light to display an image. In this period, the first scan pulse S1 remains low and the second scan pulse S2 remains high. Also in this period, the ramp voltage Vramp is outputted from the data driver and then applied to the data line DL. Namely, the data driver outputs the data voltage Vd in the above-stated write period, and the ramp voltage Vramp in the subsequent display period.

Here, the data voltage Vd is a gray-scale voltage representing the level of brightness of an image, which is a DC voltage having a different value depending on the brightness level of the image. The ramp voltage Vramp is a time-varying voltage determining a turn-on time of the first NMOS transistor Tr1 according to the level of the data voltage Vd, which has the same value for all pixels.

In other words, the turn-on time of the first NMOS transistor Tr1 depends on the level of the data voltage Vd, and a sustain time of the current flowing between the drain terminal and source terminal of the first NMOS transistor Tr1 depends on the turn-on time of the first NMOS transistor Tr1, thereby controlling a light emission time of the OLED. Consequently, the light emission time of the OLED is determined according to the level of the data voltage Vd, and the brightness level of the image is determined according to the light emission time of the OLED.

The ramp voltage Vramp will hereinafter be described in more detail.

The ramp voltage Vramp has a triangle waveform that linearly increases to a peak voltage with time and linearly decreases from the peak voltage with time upon reaching the peak voltage, as shown in FIG. 5. The peak voltage has the same level as that of the voltage VDD supplied from the voltage supply line 210. That is, the ramp voltage Vramp is a time-varying voltage that linearly increases and decreases between a minimum voltage (ground voltage) and a maximum voltage (voltage VDD) with time.

A description will hereinafter be given of the operation of the circuit of FIG. 2 in the case where the ramp voltage Vramp is applied from the data line DL to the second node b.

First, in the write period, the data voltage Vd is applied to the second node b. Thereafter, in the display period, the second node b is updated with the ramp voltage Vramp. As a result, due to the voltage difference Vd−Vth stored in the capacitor C, a voltage difference Vramp−(Vd−Vth) between the ramp voltage Vramp applied to the second node b and the voltage stored in the capacitor C is applied to the first node a.

That is, the ramp voltage Vramp is sustained at the second node b and the voltage difference Vramp−(Vd−Vth) is sustained at the first node a.

At this time, when the ramp voltage Vramp applied to the second node b in the display period is lower than the data voltage Vd applied to the second node b in the write period, the voltage Vramp−(Vd−Vth) at the first node a becomes lower than the threshold voltage Vth of the first NMOS transistor Tr1.

Here, because the first node a signifies the gate terminal of the first NMOS transistor Tr1, a voltage lower than the threshold voltage Vth of the first NMOS transistor Tr1 is applied to the gate terminal of the first NMOS transistor Tr1 when the ramp voltage Vramp applied to the second node b is lower than the data voltage Vd. As a result, the first NMOS transistor Tr1 is turned off, thereby causing the OLED to emit no light. This period corresponds to the fourth period T4 in the display period of FIG. 5.

Meanwhile, at the time that the ramp voltage Vramp applied to the second node b becomes equal to the data voltage Vd as it linearly increases with time, the voltage Vramp−(Vd−Vth) at the first node a becomes equal to the threshold voltage Vth of the first NMOS transistor Tr1.

Here, because the first node a signifies the gate terminal of the first NMOS transistor Tr1 as stated previously, a voltage equal to the threshold voltage Vth of the first NMOS transistor Tr1 is applied to the gate terminal of the first NMOS transistor Tr1 when the ramp voltage Vramp applied to the second node b is equal to the data voltage Vd. In this case, the first NMOS transistor Tr1 is turned on or off. Thus, the OLED emits light or flickers. This period corresponds to the boundary between the fourth period T4 and the fifth period T5 in the display period of FIG. 5.

Thereafter, at the time that the ramp voltage Vramp applied to the second node b becomes higher than the data voltage Vd as it linearly increases with time, the voltage Vramp−(Vd−Vth) at the first node a becomes higher than the threshold voltage Vth of the first NMOS transistor Tr1.

Here, because the first node a signifies the gate terminal of the first NMOS transistor Tr1 as stated previously, a voltage higher than the threshold voltage Vth of the first NMOS transistor Tr1 is applied to the gate terminal of the first NMOS transistor Tr1 when the ramp voltage Vramp applied to the second node b is higher than the data voltage Vd. In this case, the first NMOS transistor Tr1 is turned on. Thus, the OLED emits light so as to display a unit image at the corresponding pixel. This period corresponds to the fifth period T5 in the display period of FIG. 5.

Thereafter, at the time that the ramp voltage Vramp applied to the second node b becomes equal to the data voltage Vd again as it linearly decreases with time, the voltage Vramp−(Vd−Vth) at the first node a again becomes equal to the threshold voltage Vth of the first NMOS transistor Tr1 as stated above. As a result, the OLED emits light or flickers. This period corresponds to the boundary between the fifth period T5 and a sixth period T6 in the display period of FIG. 5.

Thereafter, at the time that the ramp voltage Vramp applied to the second node b becomes lower than the data voltage Vd as it linearly decreases with time, the voltage Vramp−(Vd−Vth) at the first node a becomes lower than the threshold voltage Vth of the first NMOS transistor Tr1 as stated above. As a result, the OLED will not emit light. This period corresponds to the sixth period T6 in the display period of FIG. 5.

In this manner, the OLED emits light or flickers in the display period. The longer the fifth period T5, namely, the longer the light emission time of the OLED, the higher the brightness of the OLED. On the contrary, the shorter the fifth period T5, namely, the shorter the light emission time of the OLED, the lower the brightness of the OLED.

This means that various gray scales can be expressed by minutely dividing the light emission time of the OLED.

Here, the length of the fifth period T5 is different depending on the level of the data voltage Vd applied to the second node b. That is, if the data voltage Vd is higher, the period in which the ramp voltage Vramp is higher than the data voltage Vd is reduced. As a result, the length of the fifth period T5 becomes shorter, resulting in a reduction in the light emission time of the OLED. On the contrary, if the data voltage Vd is lower, the period in which the ramp voltage Vramp is higher than the data voltage Vd is increased. As a result, the length of the fifth period T5 becomes longer, resulting in an increase in the light emission time of the OLED.

Meanwhile, in the present embodiment, the threshold voltage Vth of the first NMOS transistor Tr1 is obtained in the write period before the OLED emits light and then subtracted from the data voltage Vd and the resulting value is stored in the capacitor C. That is, information regarding the threshold voltage Vth of the first NMOS transistor Tr1 is stored in the capacitor C. The stored threshold voltage Vth is offset and removed by the threshold voltage Vth of the first NMOS transistor Tr1 in the subsequent display period.

In other words, as can be seen from the equation representing the voltage Vramp−(Vd−Vth) at the first node a in the display period, the threshold voltage Vth contained in the voltage at the first node a is offset and removed by the threshold voltage Vth of the first NMOS transistor Tr1 as it is inputted to the gate terminal of the first NMOS transistor Tr1. Whether the first NMOS transistor Tr1 is turned on is determined according to whether the remaining voltage, namely, the voltage Vramp−Vd obtained by excluding the threshold voltage Vth of the first NMOS transistor Tr1 from the voltage Vramp−(Vd−Vth) at the first node a, is positive or negative in polarity. Here, the polarity of the voltage Vramp−Vd with the exclusion of the threshold voltage Vth will change depending on whether the ramp voltage Vramp is higher or lower than the data voltage Vd.

In detail, as can be seen from the equation, Vramp−Vd, when the ramp voltage Vramp is higher than the data voltage Vd, the voltage at the first node a is maintained at the positive polarity, thereby causing the first NMOS transistor Tr1 to be turned on. On the contrary, when the ramp voltage Vramp is lower than the data voltage Vd, the voltage at the first node a is maintained at the negative polarity, thereby causing the first NMOS transistor Tr1 to be turned off.

Therefore, even though the threshold voltage Vth of the first NMOS transistor Tr1 varies due to a deterioration of the first NMOS transistor Tr1, the organic electro-luminescent display device according to the first embodiment of the present invention is not affected by such a variation. As a result, the organic electro-luminescent display device according to the first embodiment is normally driven even though the threshold voltage Vth varies due to a deterioration of the first NMOS transistor Tr1.

Next, a detailed description will be given of an organic electro-luminescent display device according to a second embodiment of the present.

Figure 7:
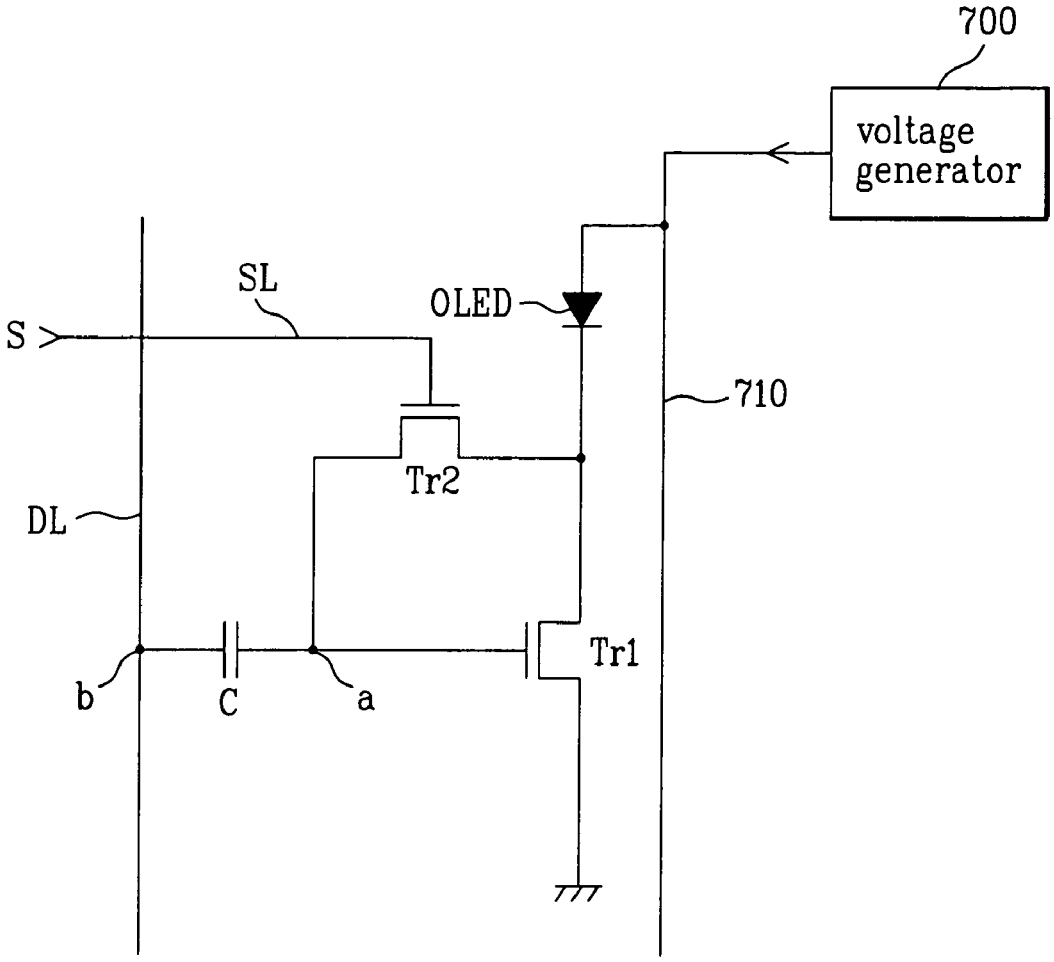
FIG. 7 is a circuit diagram showing an equivalent circuit of one pixel in an organic electro-luminescent display device according to a second embodiment of the present invention.
Figure 8:
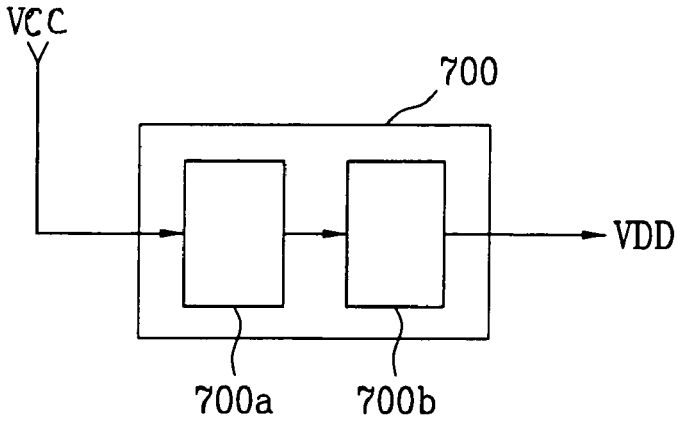
FIG. 8 is a detailed diagram of a voltage generator in FIG. 7.

FIG. 7 is a circuit diagram showing an equivalent circuit of one pixel in the organic electro-luminescent display device according to the second embodiment of the present invention, and FIG. 8 is a detailed diagram of a voltage generator in FIG. 7.

The one pixel structure of the organic electro-luminescent display device according to the second embodiment of the present invention comprises, as shown in FIG. 7, an organic light emitting device OLED for emitting light in response to current applied thereto, a scan line SL for transferring a scan pulse S from a gate driver, a data line DL for transferring a data voltage Vd and ramp voltage Vramp from a data driver, a first NMOS transistor Tr1 connected to a cathode of the organic light emitting device, for applying the current to the OLED for a different time depending on the level of the data voltage Vd from the data line DL, and a second NMOS transistor Tr2 connected between the gate terminal and drain terminal of the first NMOS transistor Tr1. The second NMOS transistor Tr2 is turned on in response to the scan pulse S from the scan line SL to form a short circuit between the gate terminal and drain terminal of the first NMOS transistor Tr1. The one pixel structure of the organic electro-luminescent display device according to the second embodiment of the present invention further comprises a voltage supply line 710 connected to an anode of the OLED for supplying a voltage VDD to the OLED, a capacitor C connected between the gate terminal of the first NMOS transistor Tr1 and the data line DL, and a voltage generator 700 for selectively supplying the voltage VDD to the OLED. The voltage generator 700 includes, as shown in FIG. 8, a power supply 700*a* for receiving an external voltage VCC, stepping it up or down to generate and output the voltage VDD and driving voltages necessary to respective components of the organic electro-luminescent display device, and a controller 700*b* for receiving the voltage VDD from the power supply 700*a* and selectively supplying it to the OLED at different time periods. The voltage generator 700 may also be located separated from the pixel area. In this case, each controller 700*b* may be within each of the pixels to control the supply of the voltage VDD to the corresponding OLED.

The pixel structure according to the second embodiment is different from that according to the first embodiment in that it does not include the third NMOS transistor Tr3, and the second scan line SL2 which transfers the second scan pulse S2 for turning on the third NMOS transistor Tr3. Therefore, the organic electro-luminescent display device according to the second embodiment of the present invention may further reduce the manufacturing cost and the pixel area.

In order to enable this structure, the voltage generator 700 is provided to control the time of supply of the voltage VDD to the OLED.

It should be noted here that the voltage VDD is of a time-varying type in the second embodiment although, in the first embodiment, it is of a time-unvarying type where it is always constant in level with time.

A detailed description will hereinafter be given of the operation of the organic electro-luminescent display device with the above-stated configuration according to the second embodiment of the present invention.

As stated previously, the circuit of FIG. 7 can be re-expressed in a circuit form in which a load, or an OLED, is connected to the drain terminal of the first NMOS transistor Tr1 (see FIG. 3). In this case, due to the connection of the OLED to the drain terminal of the first NMOS transistor Tr1, the higher the input voltage to the gate terminal of the first NMOS transistor Tr1, the lower the output voltage from the drain terminal of the first NMOS transistor Tr1.

Therefore, the first NMOS transistor Tr1 in the second embodiment is operated to exhibit the above-stated inverter characteristic curve 401 shown in FIG. 4, similarly to that in the first embodiment.

The operation of one pixel in the organic electro-luminescent display device according to the second embodiment of the present invention will hereinafter be described in detail on the basis of this principle.

Figure 9:
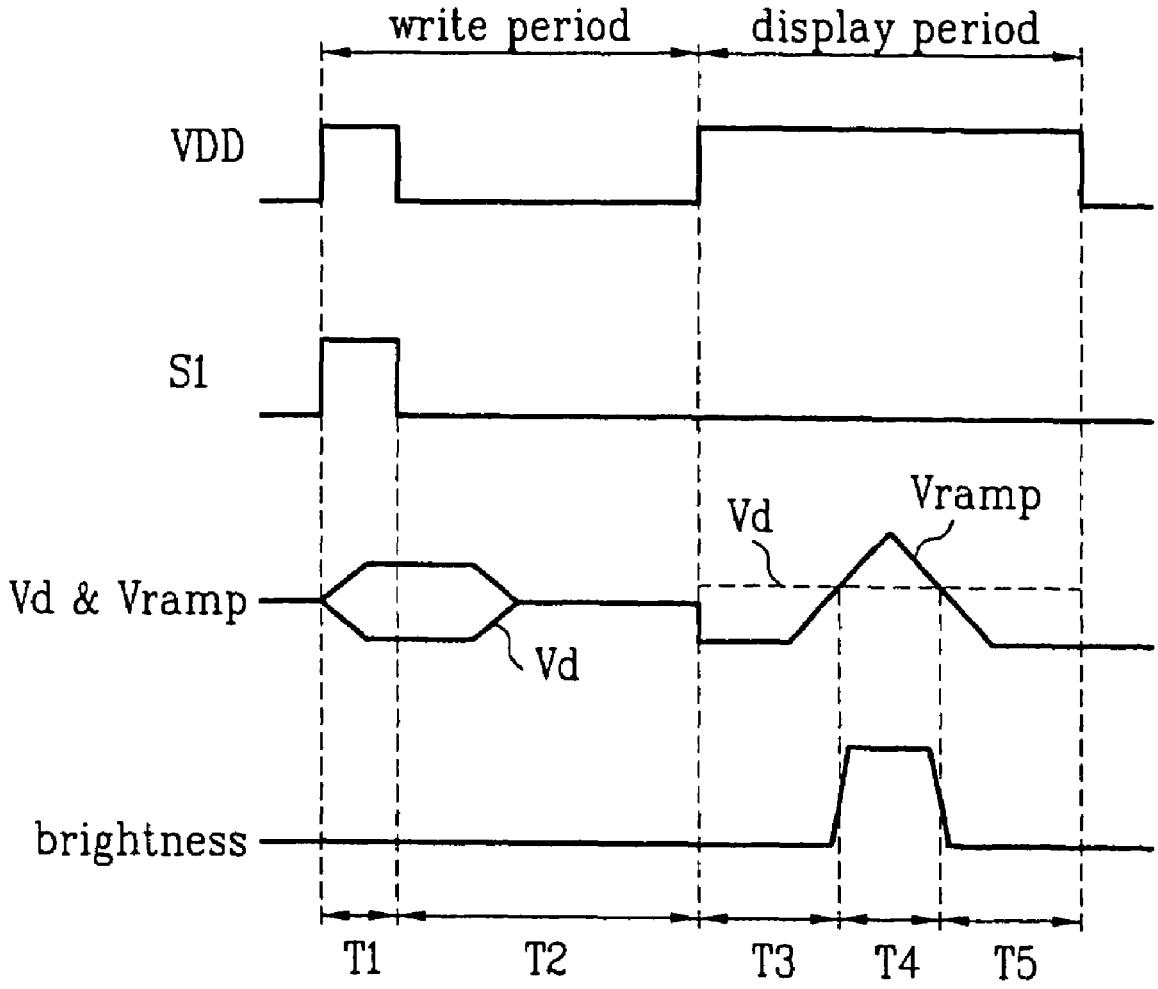
FIG. 9 is a timing diagram of various signals which are applied to the circuit of FIG. 7.
Figure 10A:
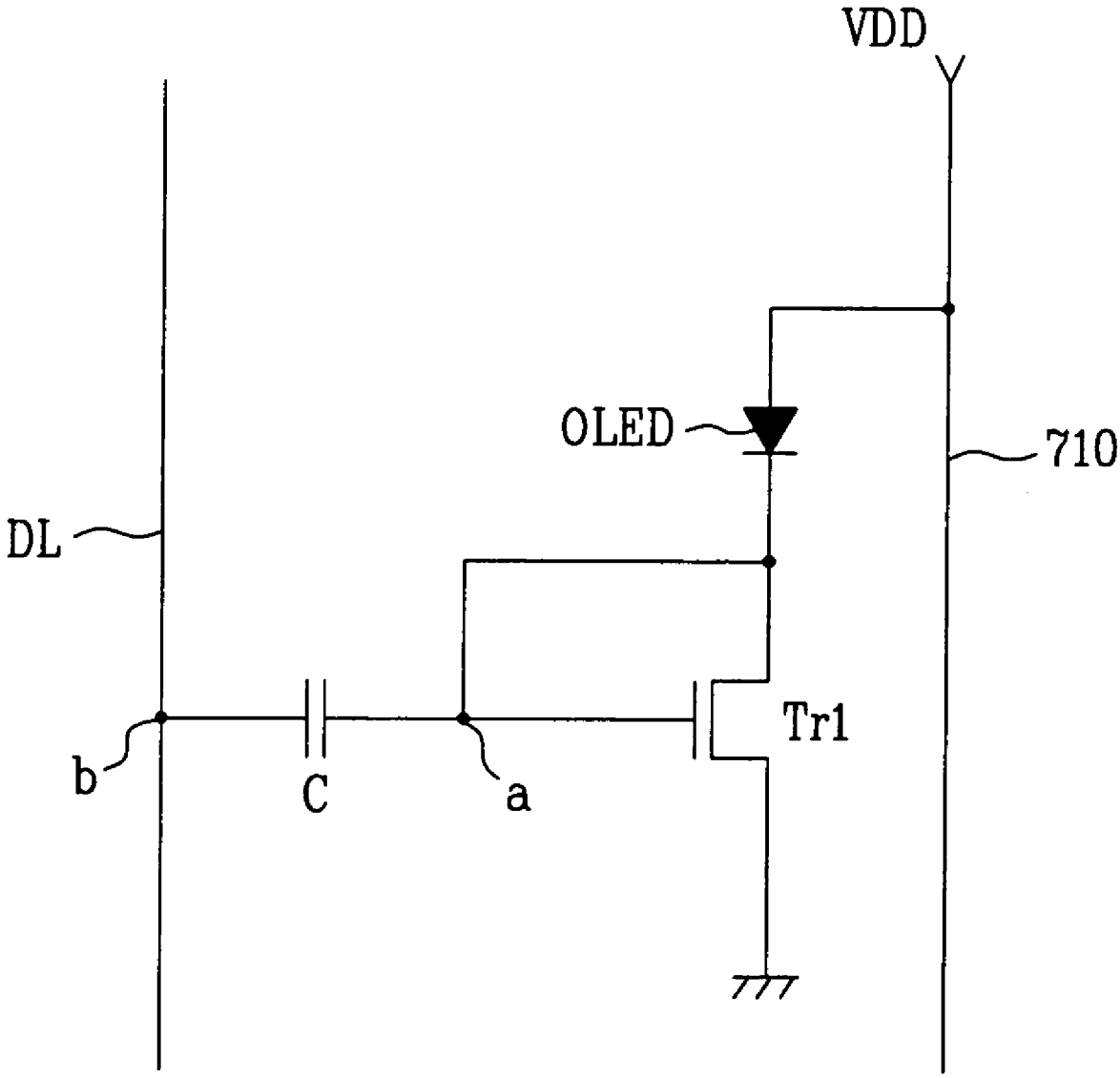
FIG. 10A is an equivalent circuit diagram of the circuit of FIG. 7 in the first period.

FIG. 9 is a timing diagram of the various signals which are applied to the circuit of FIG. 7, and FIG. 10A is an equivalent circuit diagram of the circuit of FIG. 7 in the first period T1.

First, in the first period T1, both the scan pulse S and voltage VDD remain high, as shown in FIG. 9. The data voltage Vd from the data driver also begins to be applied to the data line DL.

As a result, in the first period T1, the second NMOS transistor Tr2 in FIG. 7 remains on. The circuit configuration in the first period T1 where the second NMOS transistor Tr2 remains on can be equivalently re-expressed as shown in FIG. 10A.

That is, as shown in FIG. 10A, the turned-on second NMOS transistor Tr2 can be expressed in the form of a short circuit. Thus, the first NMOS transistor Tr1 can be expressed in the form of a diode as a short circuit is formed between the gate terminal and drain terminal thereof.

For this reason, the gate terminal and drain terminal of the first NMOS transistor Tr1 have the same voltage. In other words, the gate terminal of the first NMOS transistor Tr1 signifies an input terminal to which the input voltage is applied, and the drain terminal of the first NMOS transistor Tr1 signifies an output terminal from which the output voltage is outputted. As shown in FIG. 4, the input voltage Vin and the output voltage Vout can be expressed as a straight line 402 as they are maintained at the same value. At this time, a voltage value at a point at which the straight line 402 and the characteristic curve 401 of the first NMOS transistor Tr1 cross each other signifies a voltage value applied to the gate terminal and drain terminal of the first NMOS transistor Tr1.

Here, the voltage applied to the gate terminal and drain terminal of the first NMOS transistor Tr1 becomes equal to a threshold voltage Vth of the first NMOS transistor Tr1 in the end. As a result, the threshold voltage Vth of the first NMOS transistor Tr1 is applied to a first node a via which the gate terminal of the first NMOS transistor Tr1 and the capacitor are connected with each other.

On the other hand, in the first period T1, the data voltage Vd applied to the data line DL is applied to a second node b to which the data line DL and the capacitor C are connected in common. Hence, the threshold value Vth and the data voltage Vd are applied to both ends of the capacitor C, respectively, thereby causing a voltage difference Vd−Vth between the data voltage Vd and the threshold voltage Vth to be charged in the capacitor C.

In summary, in the first period T1, the voltage difference Vd−Vth between the data voltage Vd and the threshold voltage Vth is stored in the capacitor C.

Next, a description will hereinafter be given of the operation of the circuit of FIG. 7 in the second period T2.

Figure 10B:
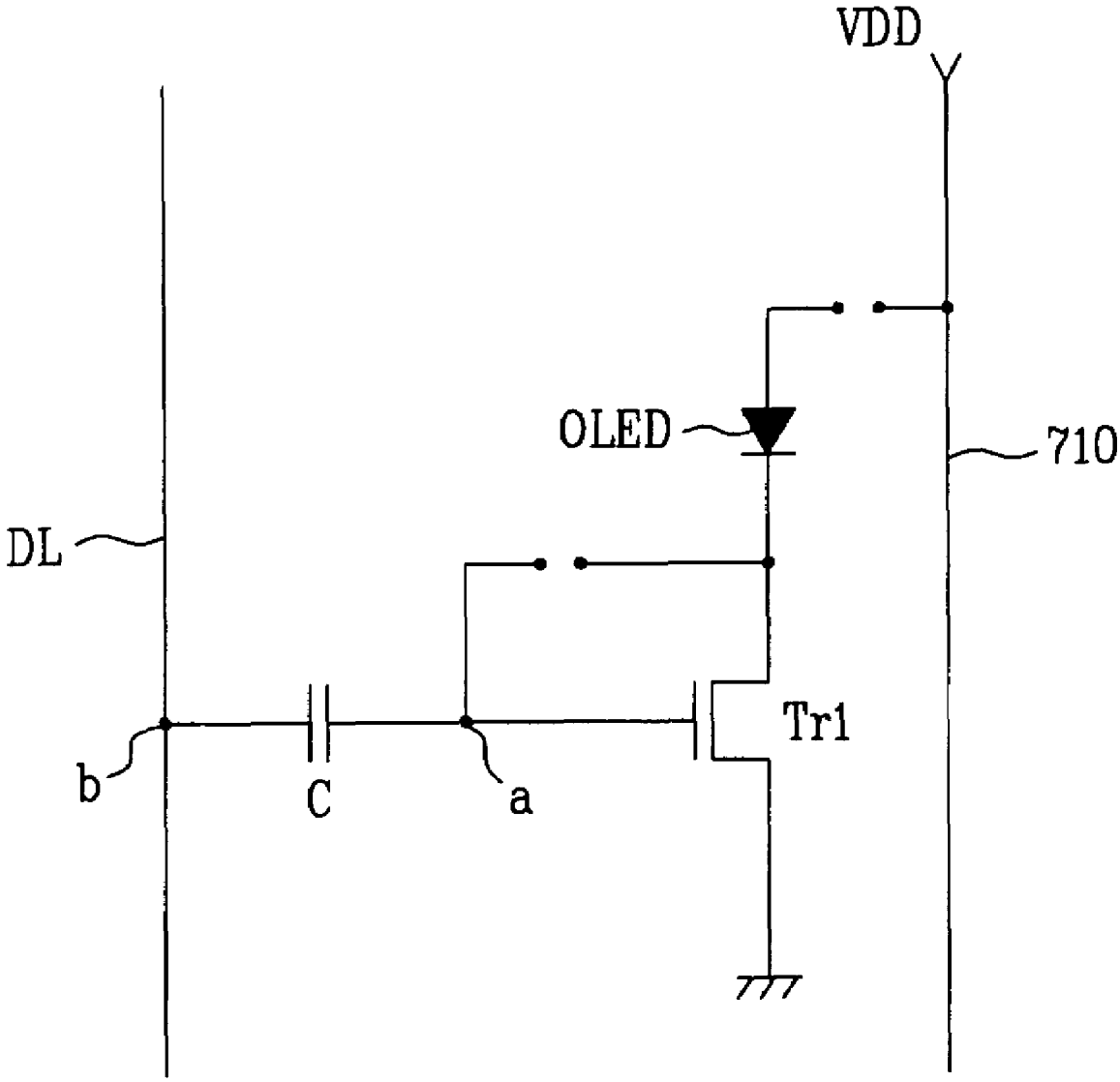
FIG. 10B is an equivalent circuit diagram of the circuit of FIG. 7 in the second period.

FIG. 10B is an equivalent circuit diagram of the circuit of FIG. 7 in the second period T2.

In the second period T2, the scan pulse S goes low and the supply of the voltage VDD is blocked, as shown in FIG. 9.

As a result, the second NMOS transistor Tr2 in FIG. 7 is turned off. As the supply of the voltage VDD is blocked, the voltage supply line 710 supplying the voltage VDD and the OLED can be expressed to be disconnected from each other.

The circuit configuration in the second period T2 where the second NMOS transistor Tr2 is turned off and the supply of the voltage VDD is blocked can be equivalently re-expressed as shown in FIG. 10B.

In this manner, in the second period T2, the voltage difference Vd−Vth between the data voltage Vd and the threshold voltage Vth, stored in the capacitor C, is sustained.

The above-described first and second periods T1 and T2 correspond to a write period for charging and sustaining the voltage difference Vd−Vth between the data voltage Vd and the threshold voltage Vth in the capacitor C. In this write period, the OLED emits no light. Of course, when the data voltage Vd is high, the OLED may emit light in the first period T1. However, because the first period T1 is considerably short, the entire screen may be considered to be displayed in black in that period.

A display period starts subsequently to the write period. A detailed description will hereinafter be given of the operation of the circuit of FIG. 7 in the display period.

Figure 10C:
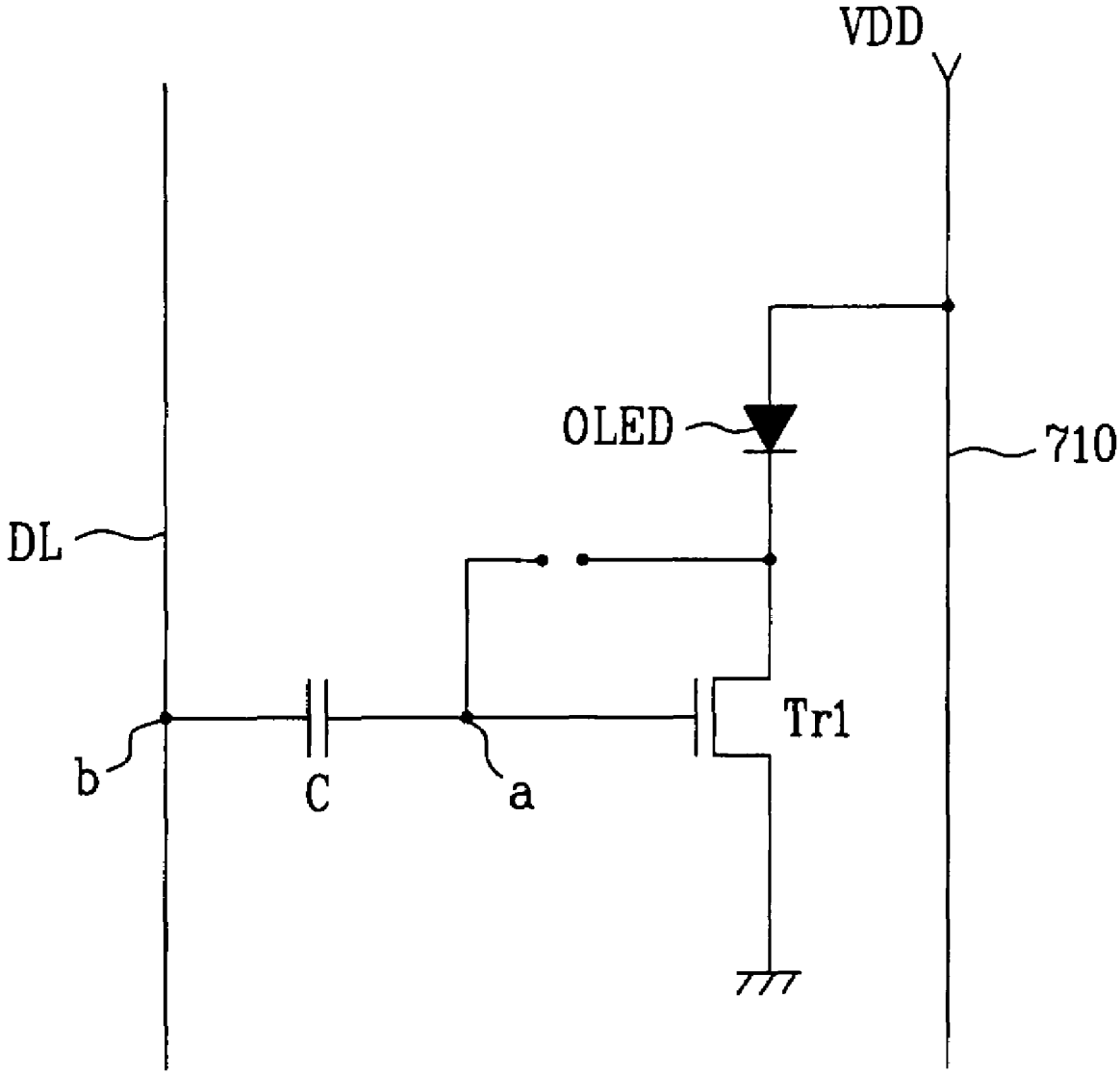
FIG. 10C is an equivalent circuit diagram of the circuit of FIG. 7 in a display period.

FIG. 10C is an equivalent circuit diagram of the circuit of FIG. 7 in the display period.

In the display period, the OLED actually emits light to display an image. In this period, the scan pulse S remains low and the supply of the voltage VDD is resumed. Also in this period, the ramp voltage Vramp is outputted from the data driver and then applied to the data line DL. Namely, the data driver outputs the data voltage Vd in the above-stated write period, and the ramp voltage Vramp in the subsequent display period.

The data voltage Vd and ramp voltage Vramp are the same as those in the first embodiment and a description thereof will thus be omitted.

A description will hereinafter be given of the operation of the circuit of FIG. 7 in the case where the ramp voltage Vramp is applied from the data line DL to the second node b.

First, in the write period, the data voltage Vd is applied to the second node b. Thereafter, in the display period, the second node b is updated with the ramp voltage Vramp. As a result, due to the voltage difference Vd−Vth stored in the capacitor C, a voltage difference Vramp−(Vd−Vth) between the ramp voltage Vramp applied to the second node b and the voltage Vd−Vth stored in the capacitor C is applied to the first node a.

That is, the ramp voltage Vramp is sustained at the second node b and the voltage difference Vramp−(Vd−Vth) is sustained at the first node a.

At this time, when the ramp voltage Vramp applied to the second node b in the display period is lower than the data voltage Vd applied to the second node b in the write period, the voltage Vramp−(Vd−Vth) at the first node a becomes lower than the threshold voltage Vth of the first NMOS transistor Tr1. Here, because the first node a signifies the gate terminal of the first NMOS transistor Tr1, a voltage lower than the threshold voltage Vth of the first NMOS transistor Tr1 is applied to the gate terminal of the first NMOS transistor Tr1 when the ramp voltage Vramp applied to the second node b is lower than the data voltage Vd. As a result, the first NMOS transistor Tr1 is turned off, thereby causing the OLED to emit no light. This period corresponds to the third period T3 in the display period of FIG. 9.

Meanwhile, at the time that the ramp voltage Vramp applied to the second node b becomes equal to the data voltage Vd as it linearly increases with time, the voltage Vramp−(Vd−Vth) at the first node a becomes equal to the threshold voltage Vth of the first NMOS transistor Tr1.

Here, because the first node a signifies the gate terminal of the first NMOS transistor Tr1 as stated previously, a voltage equal to the threshold voltage Vth of the first NMOS transistor Tr1 is applied to the gate terminal of the first NMOS transistor Tr1 when the ramp voltage Vramp applied to the second node b is equal to the data voltage Vd. In this case, the first NMOS transistor Tr1 is turned on or off. Thus, the OLED emits light or flickers. This period corresponds to the boundary between the third period T3 and the fourth period T4 in the display period of FIG. 9.

Thereafter, at the time that the ramp voltage Vramp applied to the second node b becomes higher than the data voltage Vd as it linearly increases with time, the voltage at the first node a becomes higher than the threshold voltage Vth of the first NMOS transistor Tr1. Here, because the first node a signifies the gate terminal of the first NMOS transistor Tr1 as stated previously, a voltage higher than the threshold voltage Vth of the first NMOS transistor Tr1 is applied to the gate terminal of the first NMOS transistor Tr1 when the ramp voltage Vramp applied to the second node b is higher than the data voltage Vd. In this case, the first NMOS transistor Tr1 is turned on. Thus, the OLED emits light so as to display a unit image at the corresponding pixel. This period corresponds to the fourth period T4 in the display period of FIG. 9.

Thereafter, at the time that the ramp voltage Vramp applied to the second node b becomes equal to the data voltage Vd again as it linearly decreases with time, the voltage at the first node a again becomes equal to the threshold voltage Vth of the first NMOS transistor Tr1 as stated above. As a result, the OLED emits light or flickers. This period corresponds to the boundary between the fourth period T4 and the fifth period T5 in the display period of FIG. 9.

Thereafter, at the time that the ramp voltage Vramp applied to the second node b becomes lower than the data voltage Vd as it linearly decreases with time, the voltage Vramp−(Vd−Vth) at the first node a becomes lower than the threshold voltage Vth of the first NMOS transistor Tr1 as stated above. As a result, the OLED will not emit light. This period corresponds to the fifth period T5 in the display period of FIG. 9.

In this manner, the OLED emits light or flickers in the display period. The longer the fourth period T4, namely, the longer the light emission time of the OLED, the higher the brightness of the OLED. On the contrary, the shorter the fourth period T4, namely, the shorter the light emission time of the OLED, the lower the brightness of the OLED.

This means that various gray scales can be expressed by minutely dividing the light emission time of the OLED.

Here, the length of the fourth period T4 depends on the level of the data voltage Vd applied to the second node b. That is, if the data voltage Vd is higher, the period in which the ramp voltage Vramp is higher than the data voltage Vd is reduced. As a result, the length of the fourth period T4 becomes shorter, resulting in a reduction in the light emission time of the OLED. On the contrary, if the data voltage Vd is lower, the period in which the ramp voltage Vramp is higher than the data voltage Vd is increased. As a result, the length of the fourth period T4 becomes longer, resulting in an increase in the light emission time of the OLED.

Meanwhile, in this embodiment, the threshold voltage Vth of the first NMOS transistor Tr1 is obtained in the write period before the OLED emits light and then subtracted from the data voltage Vd and the resulting value is stored in the capacitor C. That is, information regarding the threshold voltage Vth of the first NMOS transistor Tr1 is stored in the capacitor C. The stored threshold voltage Vth is offset and removed by the threshold voltage Vth of the first NMOS transistor Tr1 in the subsequent display period.

That is, as can be seen from the equation representing the voltage Vramp−(Vd−Vth) at the first node a in the display period, the threshold voltage Vth contained in the voltage Vramp−(Vd−Vth) at the first node a is offset and removed by the threshold voltage Vth of the first NMOS transistor Tr1 as it is inputted to the gate terminal of the first NMOS transistor Tr1. Whether the first NMOS transistor Tr1 is turned on is determined according to whether the remaining voltage, namely, a voltage Vramp−Vd obtained by excluding the threshold voltage Vth of the first NMOS transistor Tr1 from the voltage Vramp−(Vd−Vth) at the first node a, is positive or negative in polarity.

Here, as can be seen from the equation, Vramp−Vd, the polarity of the voltage at the first node a is different depending on whether the ramp voltage Vramp is higher or lower than the data voltage Vd. In detail, as can be seen from the equation, Vramp−Vd, when the ramp voltage Vramp is higher than the data voltage Vd, the voltage at the first node a is maintained at the positive polarity, thereby causing the first NMOS transistor Tr1 to be turned on. On the contrary, when the ramp voltage Vramp is lower than the data voltage Vd, the voltage at the first node a is maintained at the negative polarity, thereby causing the first NMOS transistor Tr1 to be turned off.

Therefore, even though the threshold voltage Vth of the first NMOS transistor Tr1 varies due to a deterioration of the first NMOS transistor Tr1, the organic electro-luminescent display device according to the second embodiment of the present invention is not affected by such a variation. As a result, the organic electro-luminescent display device according to the second embodiment of the present invention is normally driven even though the threshold voltage Vth varies due to a deterioration of the first NMOS transistor Tr1. Further, the organic electro-luminescent display device according to the second embodiment can reduce the pixel unit area and manufacturing cost in that the number of switching devices and the number of scan lines SL can be reduced, as compared with that according to the first embodiment.

As apparent from the above description, the organic electro-luminescent display-device and the method for driving the same according to the illustrated embodiments of the present invention have advantages as follows.

First, the threshold voltage of the first NMOS transistor is always stored in the write period before the display period, and then offset and removed by the threshold voltage of the first NMOS transistor in the subsequent display period. Therefore, even though the threshold voltage of the first NMOS transistor varies due to a deterioration of the first NMOS transistor, the organic electro-luminescent display device is not affected by such a variation. As a result, the organic electro-luminescent display device can be driven in such a manner that the high reliability can be maintained regardless of a variation in the threshold voltage of the first NMOS transistor.

Second, the voltage to the first NMOS transistor is driven in the time-varying manner, resulting in reduction in the number of switching devices and the number of scan lines for turning on the switching devices. It is therefore possible to reduce the area of a pixel unit and manufacturing cost.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic electroluminescent display device, comprising:

a light emitting device in a pixel to emit light in response to a current applied thereto;

a data line for providing a data voltage in a write period and a ramp voltage in a display period; and a first switching device connected to the light emitting device, the first switching device being selectively turned on depending on a voltage difference between the ramp voltage and the data voltage so as to drive the light emitting device, wherein the first switching device is turned on when the ramp voltage is equal to or higher than the data voltage so as to drive the light emitting device, and the first switching device is turned off when the ramp voltage is lower than the data voltage.

2. The display device of claim 1, wherein the ramp voltage varies with time.

3. The display device of claim 2, wherein the ramp voltage has a substantially triangle waveform.

4. The display device of claim 3, wherein the ramp voltage substantially linearly increases from a minimum, value to a maximum value and substantially linearly decreases from the maximum value to the minimum value.

5. The display device of claim 4, wherein the data voltage represents a gray level of an image and is between the maximum value and minimum value of the ramp voltage.

6. The display device of claim 1, further comprising a capacitor between the data line and a gate terminal of the first switching device, for storing a voltage difference between the data voltage and a threshold voltage of the first switching device.

7. The display device of claim 1, further comprising:

a scan line for providing a scan signal; and a second switching device, the second switching device being turned on in response to the scan signal to provide a current path between one of an anode and a cathode of the light emitting device and a gate terminal of the first switching device.

8. The display device of claim 7, further comprising:

a second scan line for providing a second scan signal; and a third switching device between the light emitting device and the first switching device, the third switching device being turned on in response to the second scan signal to provide a current path between the one of the anode and the cathode of the light emitting device and one of a drain terminal and a source terminal of the first switching device.

9. The display device of claim 1, further comprising a power supply to supply a driving voltage to an anode of the light emitting device.

10. The display device of claim 9, wherein a maximum value of the ramp voltage is substantially same as the driving voltage.

11. The display device of claim 9, wherein the power supply supplies the driving voltage during the write period and the display period.

12. The display device of claim 9, further comprising a controller for controlling the power supply to stop supplying the driving voltage after a first period of the write period and to supply the driving voltage during the entire display period.

13. A method for driving an organic electro-luminescent display device, comprising:

supplying a data voltage via a data line during a write period to charge a capacitor between the data line and a first switching device;

supplying a ramp voltage via the data line during a display period; and selectively turning on the first switching device depending on a voltage difference between the ramp voltage and the data voltage so as to drive the light emitting device, wherein the step of selectively turning on the first switching device includes turning on the first switching when the ramp voltage is equal to or higher than the data voltage so as to drive a light emitting device and turning off the first switching device when the ramp voltage is lower than the data voltage.

14. The method of claim 13, further comprising adjusting a level of the data voltage to control a light emission period of the light emitting device.

15. The method of claim 13, wherein the step of supplying the ramp voltage includes supplying the ramp voltage which has a value varying with time.

16. The method of claim 15, wherein the step of supplying the ramp voltage includes supplying the ramp voltage having a substantially triangle waveform.

17. The method of claim 16, wherein the step of supplying the ramp voltage includes substantially linearly increasing the ramp voltage from a minimum value to a maximum value and substantially linearly decreasing the ramp voltage from the maximum value to the minimum value.

18. The method of claim 13, further comprising supplying a scan signal in a first period of the write period to turn on a second switching device between one of an anode and a cathode of the light emitting device and a gate terminal of the first switching device so as to provide a current path between the one of the anode and the cathode of the light emitting device and the gate terminal of the first switching device.

19. The method of claim 18, further comprising supplying a second scan signal in the first period and a second period of the write period to a third switching device between the light emitting device and the first switching device so as to provide a current path between the one of the anode and the cathode of the light emitting device and one of a drain terminal and a source terminal of the first switching device.

20. The method of claim 13, further comprising supplying a driving voltage to an anode of the light emitting device.

21. The method of claim 20, wherein the step of supplying the driving voltage includes supplying the driving voltage during the write period and the display period.

22. The method of claim 20, wherein a maximum value of the ramp voltage is substantially same as the driving voltage.

23. The method of claim 20, wherein the step of supplying the driving voltage includes:

supplying the driving voltage in a first period of the write period;

stopping supplying of the driving voltage in the rest of the write period; and supplying the driving voltage during the entire display period.

24. The method of claim 13, wherein the step of supplying the data voltage during the write period to charge the capacitor includes charging the capacitor to a voltage difference between the data voltage and a threshold voltage of the first switching device.

* * * * *